US008371673B2

(12) United States Patent
Maru et al.

(10) Patent No.: US 8,371,673 B2
(45) Date of Patent: Feb. 12, 2013

(54) PRINTING APPARATUS AND INK REMAINING AMOUNT DETECTION METHOD

(75) Inventors: Akiko Maru, Tokyo (JP); Kiichiro Takahashi, Yokohama (JP); Tetsuya Edamura, Kawasaki (JP); Minoru Teshigawara, Yokohama (JP); Yoshiaki Murayama, Tokyo (JP); Takatoshi Nakano, Tokyo (JP); Hiroshi Taira, Chofu (JP)

(73) Assignee: Canon Kabushiki Kaisha, Tokyo (JP)

( * ) Notice: Subject to any disclaimer, the term of this patent is extended or adjusted under 35 U.S.C. 154(b) by 594 days.

(21) Appl. No.: 12/100,683

(22) Filed: Apr. 10, 2008

(65) Prior Publication Data

US 2008/0266336 A1 Oct. 30, 2008

(30) Foreign Application Priority Data

Apr. 24, 2007 (JP) ..... 2007-114503

(51) Int. Cl.
*B41J 29/38* (2006.01)
*B41J 2/195* (2006.01)
*B41J 29/393* (2006.01)

(52) U.S. Cl. ..... 347/19; 347/6; 347/7

(58) Field of Classification Search ..... 347/6–7, 347/19

See application file for complete search history.

(56) References Cited

U.S. PATENT DOCUMENTS

| | | | | |
|---|---|---|---|---|
| 5,929,885 | A | 7/1999 | Nakajima et al. | |
| 5,940,094 | A | 8/1999 | Otsuka et al. | |
| 6,070,975 | A * | 6/2000 | Uchikata et al. | 347/86 |
| 6,089,686 | A * | 7/2000 | Thornton et al. | 347/7 |
| 6,142,600 | A | 11/2000 | Takahashi et al. | |
| 6,145,950 | A | 11/2000 | Ohtsuka et al. | |
| 6,352,327 | B1 | 3/2002 | Yano et al. | |
| 6,511,150 | B1 * | 1/2003 | Yoda et al. | 347/23 |
| 6,619,776 | B2 * | 9/2003 | Yoshiyama et al. | 347/7 |
| 7,354,133 | B2 | 4/2008 | Ide et al. | |
| 7,604,344 | B2 | 10/2009 | Seki et al. | |
| 2002/0085051 | A1 * | 7/2002 | Saruta | 347/7 |
| 2008/0122884 | A1 | 5/2008 | Ide et al. | |
| 2010/0321436 | A1 | 12/2010 | Nakano et al. | |
| 2011/0085003 | A1 | 4/2011 | Oonuki et al. | |

FOREIGN PATENT DOCUMENTS

| | | | |
|---|---|---|---|
| JP | 06-226989 | A | 8/1994 |
| JP | 08-112910 | A | 5/1996 |
| JP | 2001-001511 | A | 1/2001 |
| JP | 2001-071471 | A | 3/2001 |

OTHER PUBLICATIONS

Office Action—Japanese Patent Appln. No. 2008-114421, Japanese Patent Office, Sep. 14, 2012.

* cited by examiner

*Primary Examiner* — Jason Uhlenhake

(74) *Attorney, Agent, or Firm* — Fitzpatrick, Cella, Harper & Scinto

(57) ABSTRACT

According to this invention, an inkjet printing apparatus having an arrangement for detecting an amount of remaining ink in an ink tank starts a printing operation in a short time immediately after power-on. If an operation in preceding use is ended without any error at the time of power-off, and no error has occurred even at the time of power-on, the inkjet printing apparatus of this invention starts the printing operation without executing the operation of detecting the amount of remaining ink in the ink tank after power-on.

14 Claims, 15 Drawing Sheets

PRINTING APPARATUS AND INK REMAINING AMOUNT DETECTION METHOD

BACKGROUND OF THE INVENTION

1. Field of the Invention

The present invention relates to a printing apparatus and an ink remaining amount detection method thereof and, more particularly, to an inkjet printing apparatus using a mechanism for detecting an amount of remaining ink and an ink remaining amount detection method thereof.

2. Description of the Related Art

Amount of remaining ink detection in an inkjet printing apparatus (to also be referred to as a printing apparatus hereinafter) is done for the purpose of preventing a discharge failure or damage to the printhead caused by a printing operation without ink, or for the purpose of prompting the user to exchange an ink tank. For example, the amount of ink in an ink tank is detected, and the remaining amount is displayed. If the amount of remaining ink is small, the apparatus issues an alarm or stops the printing operation.

Various methods of detecting the amount of remaining ink in an ink tank have been proposed (Japanese Patent Laid-Open No. H6-226989). In some cases, a plurality of amount of remaining ink detection methods are implemented in parallel.

One of the methods of detecting the amount of remaining ink in an ink tank detects the amount of remaining ink using an optical sensor every time the amount of consumed ink, which is calculated from the number of times of ink discharge and the number of times of suction to recover the printhead, reaches a predetermined amount (Japanese Patent Laid-Open No. H8-112910). This is a very accurate amount of remaining ink detection method capable of preventing the detection accuracy from becoming poor because of, for example, variations in the optical sensor itself serving as a detection unit, variations generated by the optical sensor attachment accuracy, and variations in manufacturing ink tanks.

FIG. 1 is a flowchart illustrating an example of a conventional amount of remaining ink remaining amount detection method which is the same as that described in Japanese Patent Laid-Open No. H8-112910.

In step S110, the amount of each ink consumed by ink discharge for a printing operation such as image formation, or preliminary discharge or ink suction executed for a printhead recovery operation is counted as the number of pulses applied for ink discharge. Note that in this prior art, the number of pulses per cycle of suction operation is calculated as $3\times10^6$ pulses.

In step S120, it is determined whether the number of pulses counted in step S110 has reached a predetermined number of pulses. In this prior art, the predetermined number of pulses is set to $15\times10^6$ pulses. If it is determined that the number of pulses has not reached the predetermined number of pulses, count is continued. If the number of pulses has reached the predetermined number of pulses, the carriage having an ink tank moves to the place of a photo interrupter to measure the light reflectance (output value) of the ink tank in step S130.

In step S140, the amounts of change between output values are calculated based on three output values in the past and that measured in step S130. The sum of the change amounts is obtained. In step S150, the sum of the output change amounts is compared with the sum calculated last time in the same way. It is determined whether the current sum has increased from the preceding sum by a predetermined value $\alpha$ or more.

If it is determined that the current sum has not increased by $\alpha$ or more, the counter for counting the number of pulses is cleared in step S190. The process returns to step S110 to count the number of pulses and acquire the output value again. If it is determined that the current sum has increased by $\alpha$ or more, the process advances to step S160 to display that the ink in the ink tank is running short. In step S170, a process of, for example, interrupting the printing operation and waiting for exchange of the ink tank is executed. The counter for counting the number of pulses is cleared (step S180). As described above, in this amount of remaining ink detection operation, every time a predetermined amount of ink is consumed, output value measurement using the photo interrupter and determination based on the output value are performed. This enables a periodic amount of remaining ink detection operation.

The timing of the amount of remaining ink detection operation is not limited to that described above. For example, when the printing apparatus is powered on, the amount of remaining ink is detected as one of its initialization operations. This operation prepares for an increase or decrease in the amount of remaining ink which is caused due to detachment of an ink tank or printhead, ink refill, or ink evaporation during a period when the printing apparatus is powered off and is incapable of storing a change in the amount of remaining ink. After powering on the printing apparatus, amount of remaining ink detection is executed to confirm the consistency with the amount of remaining ink stored in the printing apparatus.

FIG. 2 is a flowchart illustrating an example of the initialization operation of the printing apparatus after power-on.

In step S240, it is determined whether to turn off or on the hard power of the printing apparatus. If the hard power is already ON, the soft power is turned on (step S250). The process advances to step S320. If the hard power is OFF, the hard power is turned on. In step S260, the soft power is turned on. In step S270, a hard power-on flag is set. The process advances to step S320.

In step S320, in association with printing medium conveyance in the sub-scanning direction with respect to the main scanning direction, that is, printhead scanning direction, an initialization process related to sub-scanning is executed to perform a mechanical operation without any problem and convey a printing medium to a predetermined initial position. In step S330, a lift-up initialization process is executed to vertically move the printhead unit without any problem and locate the printhead at a predetermined initial position. In step S340, a recovery system initialization process is executed to operate, without any problem, a pump, wiper, and cap to be used to clean the printhead and keep it in a good state and place these components at predetermined initial positions. The main body mechanism is initialized in the above-described way in steps S320, S330, and S340. In step S380, the tank is detected to confirm that the ink tank is accurately attached. In step S390, the amount of remaining ink is detected to confirm the amount of remaining ink in the ink tank. In step S400, a suction operation of cleaning the printhead is performed as needed (step S410) based on the elapse time from the last use. In step S420, the printing operation starts.

However, the amount of remaining ink detection operation using an optical unit requires to move the carriage to the position of an amount of remaining ink sensor such as a photo interrupter for light reflectance detection.

Japanese Patent Laid-Open No. H6-226989 described above also shows an arrangement for detecting the amount of remaining ink in an ink tank. However, it is necessary to move the printhead including an ink tank to the position of an amount of remaining ink sensor for amount of remaining ink detection, and the movement takes time. Hence, even when the user wants to print immediately after powering on the printing apparatus, he or she must wait for the end of amount of remaining ink detection operation before the start of printing.

SUMMARY OF THE INVENTION

The present invention is directed to an inkjet printing apparatus and an amount of remaining ink detection method.

The present invention has been made to solve the problem of the prior art, and has as its object to provide an inkjet printing apparatus capable of shortening the time from power-on to the start of printing, and an amount of remaining ink detection method thereof.

According to one aspect of the present invention, preferably, there is provided a printing apparatus for printing using a printhead which discharges, from orifices, an ink contained in an ink tank, comprising:

detection means for detecting an ink remaining amount in the ink tank;

storage means for storing information indicating whether an error has occurred at a time of power-off; and control means for controlling an operation of the detection means in an initialization operation after power-on on the basis of the information stored in the storage means.

According to another aspect of the present invention, preferably, there is provided a printing apparatus for printing using a printhead which discharges, from orifices, an ink contained in an ink tank, comprising:

detection means for detecting an ink remaining amount in the ink tank; and control means for controlling to inhibit an operation of the detection means when a hard power-on process is executed at a time of power-on.

According to still another aspect of the present invention, preferably, there is provided an ink remaining amount detection method of detecting an ink remaining amount in an ink tank in a printing apparatus for printing using a printhead which discharges, from orifices, an ink contained in the ink tank, the method comprising the steps of:

storing information indicating whether an error has occurred at a time of power-off; and controlling an operation of detecting the ink remaining amount in an initialization operation after power-on on the basis of the information stored in the storing step.

The invention is particularly advantageous since it can provide an inkjet printing apparatus which has an arrangement for detecting an amount of remaining ink in an ink tank and can start a printing operation in a short time immediately after power-on, and an amount of remaining ink detection method thereof.

Further features of the present invention will become apparent from the following description of exemplary embodiments (with reference to the attached drawings).

BRIEF DESCRIPTION OF THE DRAWINGS

FIG. 2 is a flowchart illustrating a conventional initialization operation after power-on;

DESCRIPTION OF THE EMBODIMENTS

The embodiments of the present invention will now be described in detail with reference to the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Figure 3:
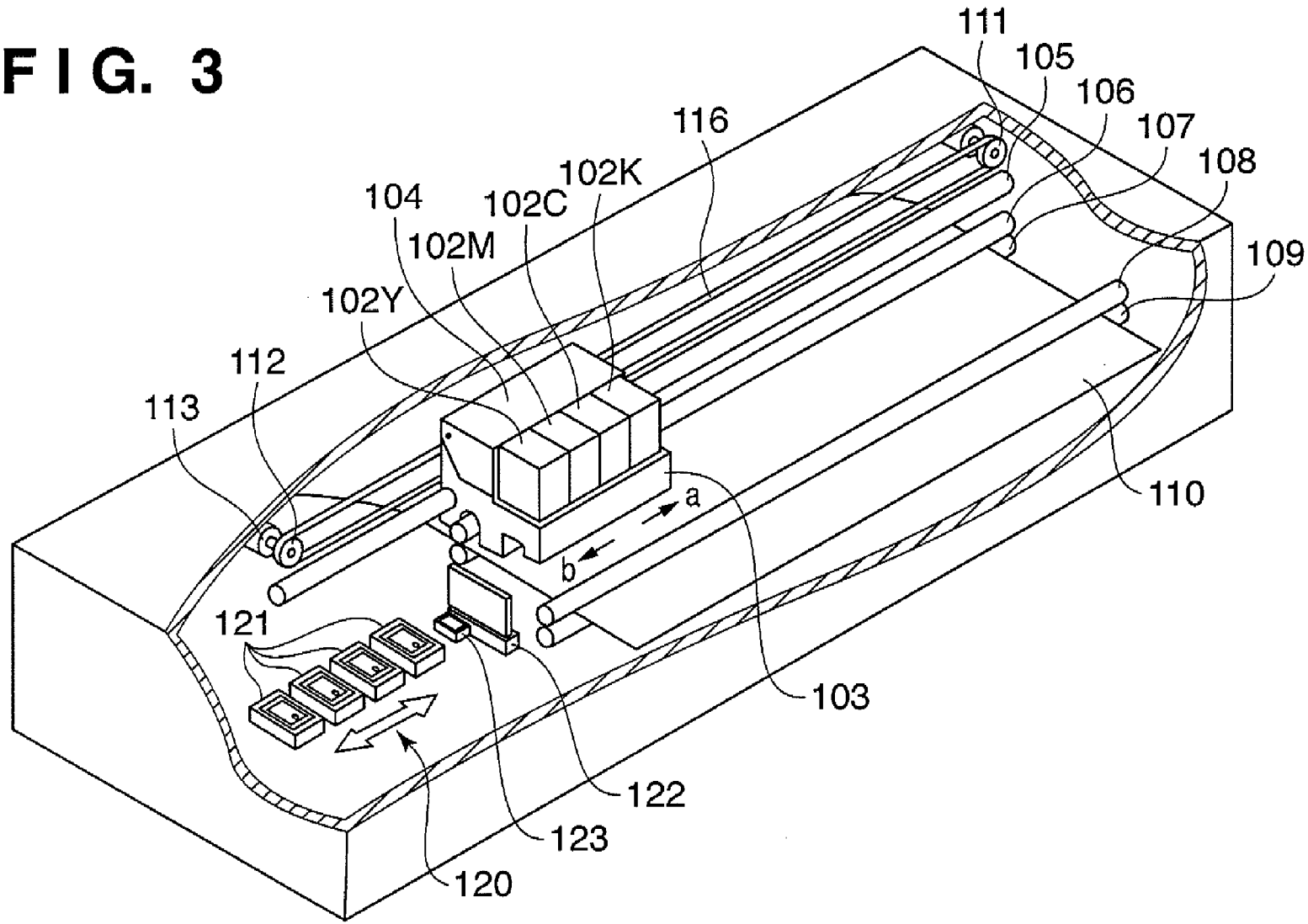
FIG. 3 is a schematic perspective view showing an inkjet printer according to an embodiment of the present invention.

FIG. 3 is a perspective view showing the schematic arrangement of the printing unit of a color inkjet printer according to an embodiment of the present invention.

Referring to FIG. 3, a fixing lever 104 detachably attaches, to a carriage 103, a head unit having a printhead which has an array of a plurality of orifices and discharges ink droplets from the orifices. The head unit is stored in the fixing lever 104. In this embodiment, the head unit integrally includes printheads of four color inks of yellow (Y), magenta (M), cyan (C), and black (K). Ink droplets discharged from the printheads form dots on, for example, printing paper 110 serving as a printing medium so that a color image or the like can be printed. An ink tank 102Y contains Y ink, an ink tank 102M contains M ink, an ink tank 102C contains C ink, and an ink tank 102K contains K ink.

The carriage 103 can move in directions of arrows a and b in FIG. 3 along a guide shaft 105 upon receiving a driving force from a carriage driving motor 113 via a motor pulley 112, idler pulley 111, and timing belt 116. On the other hand, two sets of conveyance rollers, that is, a set of conveyance rollers 106 and 107 provided upstream in the conveyance direction and a set of conveyance rollers 108 and 109 provided downstream convey the printing paper 110.

A platen (not shown) supports the reverse surface of the printing paper 110 to form a flat print surface at a position opposing the orifices of the printhead. The above-described scan of the printhead based on the movement of the carriage 103 and the conveyance of the printing paper 110 by the conveyance rollers 106 to 109 allow sequentially forming an image in a predetermined area of the printing paper 110.

An electric circuit serving as the control unit of the printer main body sends image data and the like to be used for printing to the driving circuit of the printhead via a flexible cable (not shown).

A recovery unit 120 is located at the home position of the printhead. The recovery unit 120 has four caps 121 arranged in correspondence with the orifice arrays of the printheads of the respective inks, and a pump unit (not shown) connected to the caps via, for example, tubes. The caps 121 can move in the vertical direction. Each cap 121 is designed to come into tight contact with a surface (to also be referred to as an orifice surface hereinafter) of a corresponding one of the printheads with the orifices and cover (cap) the orifices when the printhead is at the home position. This capping prevents the ink in the orifices from thickening or solidifying due to evaporation. Hence, discharge failures can be prevented. If an ink tank is exchanged, or a discharge failure has occurred in a printhead, a suction recovery process is executed, in which the pump unit is actuated under the above-described capping state to set a negative pressure in the caps, and the inks are sucked from the orifices by a suction force generated by the negative pressure so that new inks are supplied. The recovery unit 120 has, between the caps 121 and the printing area, a wiper blade 122 for cleaning the orifice surfaces of the printheads by wiping ink droplets sticking to them.

A photo interrupter 123 for optically detecting the amount of remaining ink is provided between the caps 121 and the wiper blade 122. The photo interrupter 123 irradiates the bottom surface of each ink tank on the carriage 103 with light, receives reflected light, and measures the light reflectance of the ink tank, as will be described later. That is, when the carriage 103 moves to make each ink tank oppose the photo interrupter, the light reflectance of each ink tank can be measured.

Figure 4A:
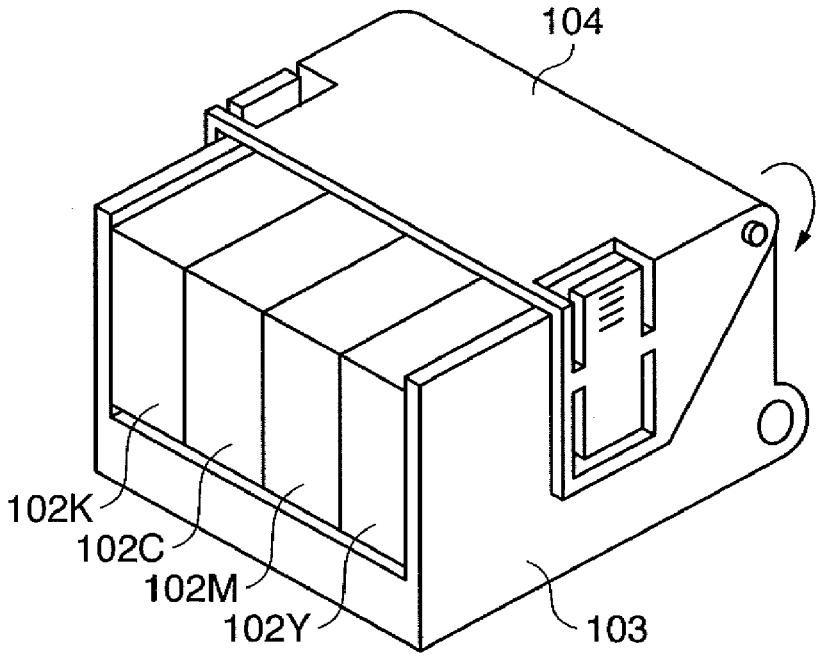
FIGS. 4A and 4B are schematic perspective views showing a head unit, ink tanks, and carriage.
Figure 4B:
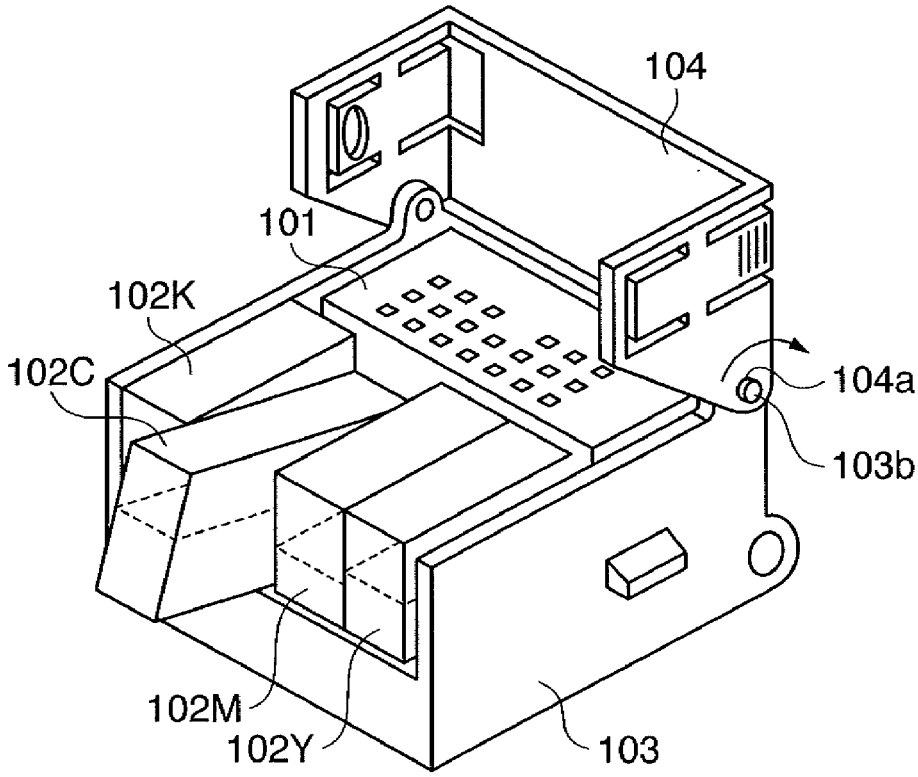

FIGS. 4A and 4B are perspective views showing the head unit and ink tanks mounted on the carriage 103.

The carriage 103 has a head unit 101 that stores four printheads (not shown) for discharging K, C, M, and Y inks. The carriage 103 also has the ink tanks 102K, 102C, 102M, and 102Y which contain the inks to be supplied to the corresponding printheads. Each of the four printheads has orifices which discharge ink droplets. Each of the four printheads is detachably attached to the carriage 103 and can be exchanged with a new ink tank when the ink has run out.

The fixing lever 104 serving as the cover member of the head unit 101 positions and fixes the head unit 101 on the carriage 103. A boss 103*b* provided at part of the carriage 103 rotatably fits in a hole 104*a* of the fixing lever 104 so as to allow the fixing lever 104 to open or close. This enables to exchange a printhead 312. When the fixing lever 104 closes, electrical signals can be connected between the printhead 312 and the apparatus main body.

Figure 5:
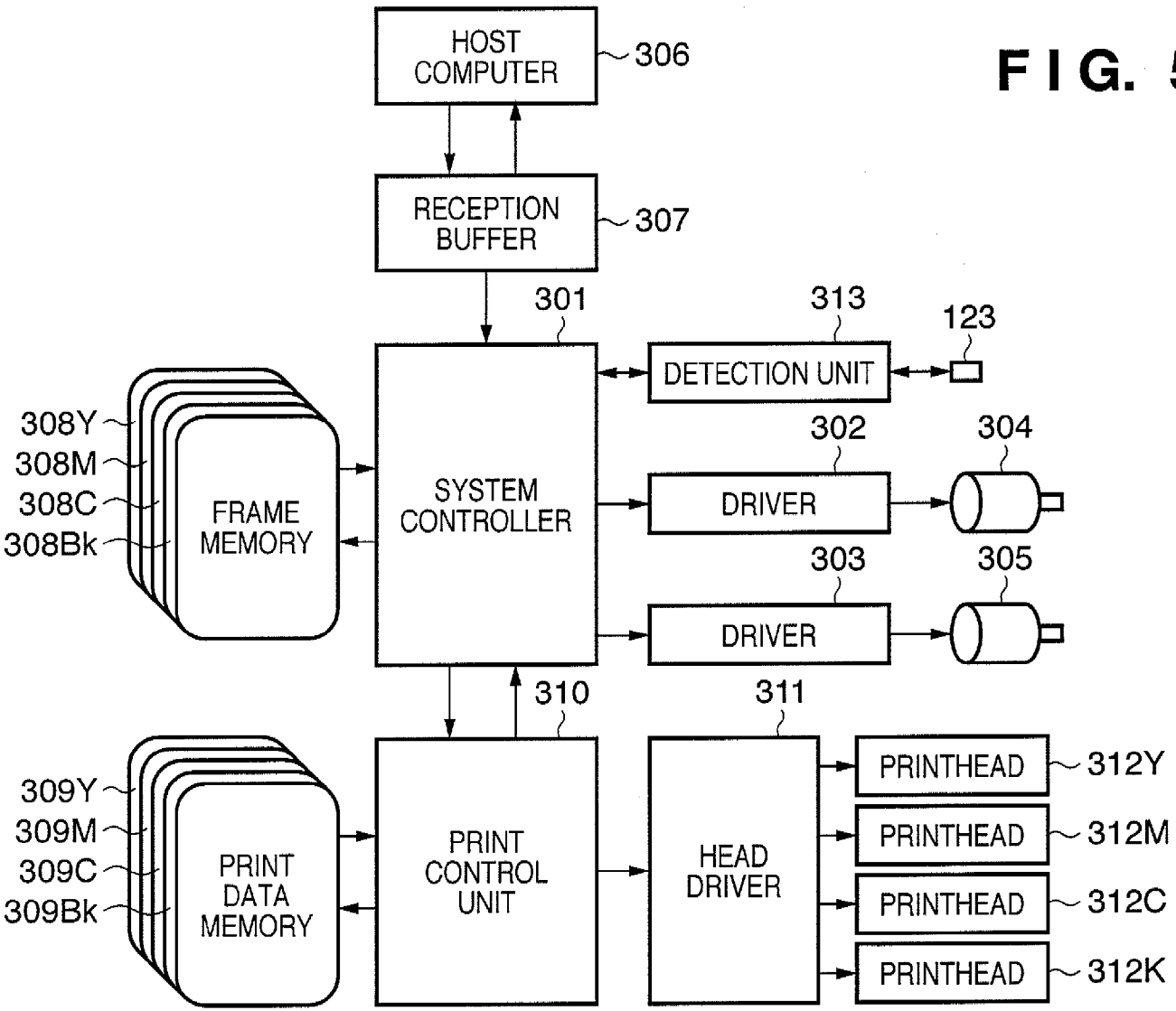
FIG. 5 is a block diagram showing the control arrangement of the inkjet printer according to the embodiment of the present invention.

FIG. 5 is a block diagram showing the control arrangement of the above-described inkjet printer.

Referring to FIG. 5, a system controller 301 controls the entire inkjet printer. The system controller 301 incorporates a microprocessor (MPU), a storage device (ROM) which stores control programs, a storage device (RAM) to be used by the MPU to execute a process, and a nonvolatile rewritable storage device such as an EEPROM.

A driver 302 drives a motor 304 to move the carriage 103. A driver 303 drives a motor 305 to convey a printing medium. That is, the motors 304 and 305 operate upon receiving information such as a speed and moving distance from a corresponding driver.

A reception buffer 307 temporarily stores data sent from a host computer 306. The reception buffer 307 stores the data until the system controller 301 reads it out. A frame memory 308 is used to rasterize print data into image data and store image data rasterized based on the data the system controller 301 reads out from the reception buffer 307. The frame memory 308 has a memory size necessary for printing. In this embodiment, the frame memory 308 can store image data for one printing medium. However, the present invention is not limited to the frame memory size, as a matter of course. A memory 309 stores print data corresponding to one line of printhead scan and has a storage capacity corresponding to the number of orifices of a corresponding printhead.

A print control unit 310 controls driving of each printhead in accordance with a command from the system controller 301. The print control unit 310 controls, for example, the discharge frequency or the number of times of discharge of each printhead. In this embodiment, the print control unit 310 also executes a process of counting the number of ink droplets discharged by each of printheads 312K, 312C, 312M, and 312Y and the number of times of suction for printhead recovery and calculating the consumed amount of each ink as the number of ink droplets (number of pulses). A driver 311 drives the printheads 312K, 312C, 312M, and 312Y to discharge the inks under the control of the print control unit 310.

A detection unit 313 obtains the output from the above-described photo interrupter 123 shown in FIG. 3 and converts it into a digital value corresponding to the output value.

Figure 6:
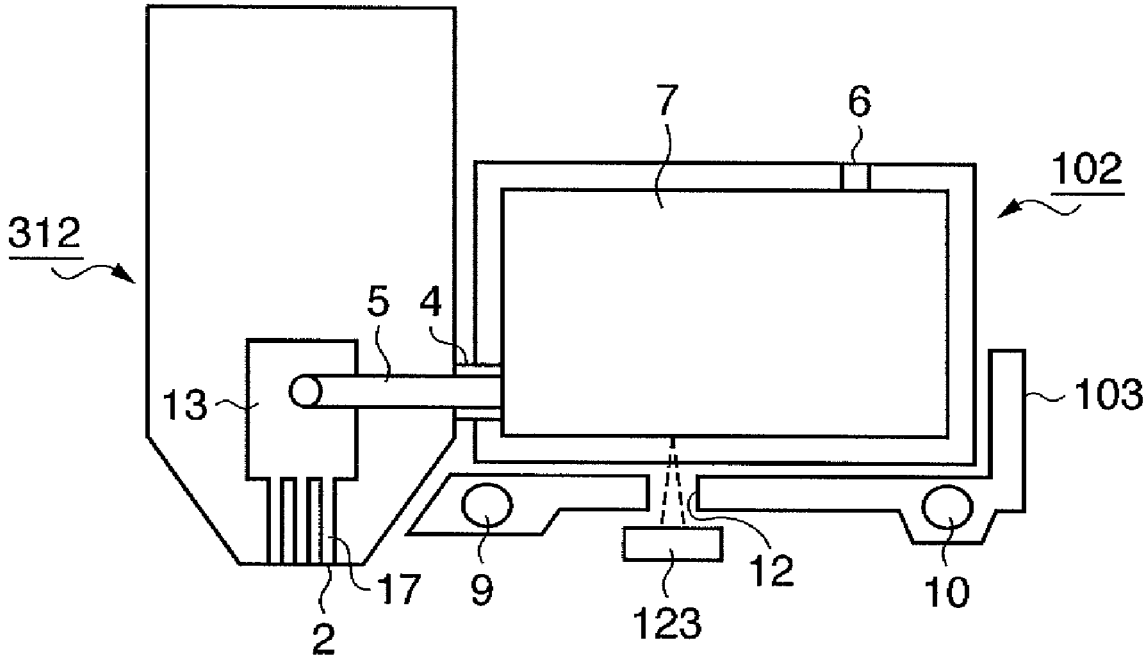
FIG. 6 is a sectional view showing the connection state between a printhead and an ink tank.
Figure 7:
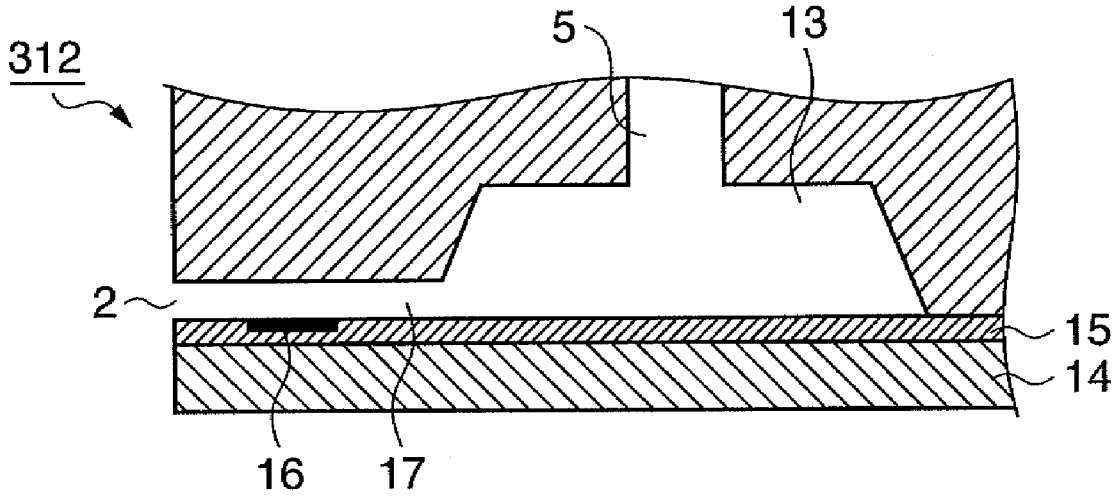
FIG. 7 is a sectional view showing a distal end portion of the printhead.

FIG. 6 is a schematic view showing a more detailed arrangement of the above-described printhead 312 and ink tank 102. FIG. 7 is a longitudinal sectional view of the printhead 312.

As shown in FIGS. 6 and 7, the printhead 312 has orifices 2 to discharge ink droplets. The orifices 2 receive the ink from the ink tank 102 via a supply port 4, supply tube 5, common ink chamber 13, and ink channels 17. A heater 16 formed on a heater board 15 attached to a base plate 14 made of, for example, A1 heats the ink supplied to each orifice 2 so that the ink is discharged from the orifice 2 as a very small droplet by bubbles generated upon heating.

The ink tank 102 has not only the above-described supply port 4 but also an air communication port 6 for gas-liquid exchange according to ink consumption. The ink tank 102 incorporates an ink absorber 7 made of, for example, polyurethane. The capillary force of the ink absorber generates an appropriate negative pressure and implements stable ink droplet discharge in printing.

The printhead 312 and ink tank 102 are mounted on the carriage 103, as described above, and scanned along shafts 9 and 10 which slidably engage with the carriage. As shown in FIG. 3, the reflection photo interrupter 123 having an LED element and a light-receiving element integrated with each other is provided at a predetermined position in the scanning direction of the carriage 103. The photo interrupter 123 can irradiate the bottom surface of the absorber 7 of the ink tank 102 with light via a hole 12 formed in the carriage 103 at the predetermined position. The LED of the photo interrupter 123 emits infrared light which can pass through all of the four color inks of black, cyan, magenta, and yellow normally used in a color printer. The light-receiving element also has a sufficient sensitivity for the wavelength of reflected light of the infrared light emitted by the LED. When the photo interrupter 123 is separated from the carriage 103, neither a feeder wire nor a signal line for the photo interrupter need be prepared between the carriage 103 and the inkjet printer main body.

Figure 8A:
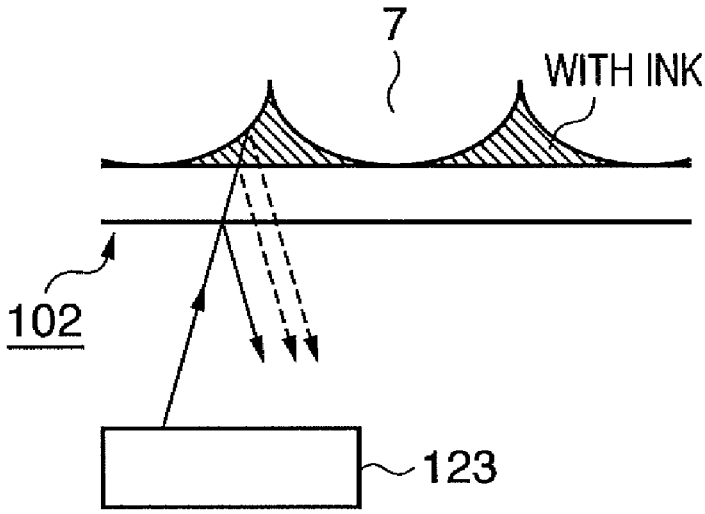
FIGS. 8A and 8B are views for explaining the principle of amount of remaining ink detection by a photo interrupter according to the embodiment of the present invention.
Figure 8B:
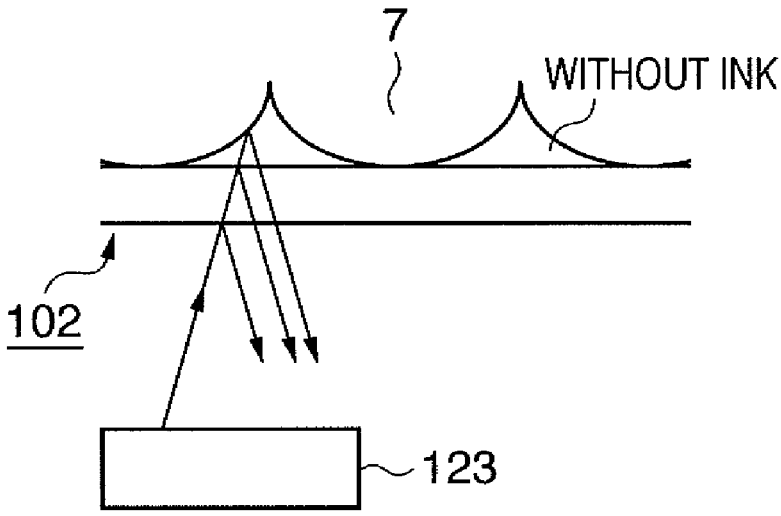

FIGS. 8A and 8B are views schematically showing states in which the photo interrupter 123 irradiates the bottom surface of the ink tank 102 with light. As shown in FIG. 8A, when the ink tank 102 contains a sufficient amount of ink, the ink fills the gap between the wall surface of the ink tank 102 and the absorber 7. As shown in FIG. 8B, when the ink tank 102 contains a small amount of ink or no ink at all, air exists in the gap between the wall surface of the ink tank 102 and the absorber 7. As a result, the reflectance of light emitted from the photo interrupter 123 is higher in the state shown in FIG. 8B than that shown in FIG. 8A. Assume that the material of the ink tank 102 and absorber 7 is plastic, its refractive index is about 1.5, and the refractive index of the ink is about 1.4. In this case, the reflectance of light in the state shown in FIG. 8B is about 40 times higher than that in the state shown in FIG. 8A. This difference allows detection of the presence/absence of ink.

Actually, the photo interrupter 123 irradiates not a point but an area having a predetermined size with light. The output from the photo interrupter 123 continuously changes because it detects that the ink is gradually running out in that area.

Figure 9A:
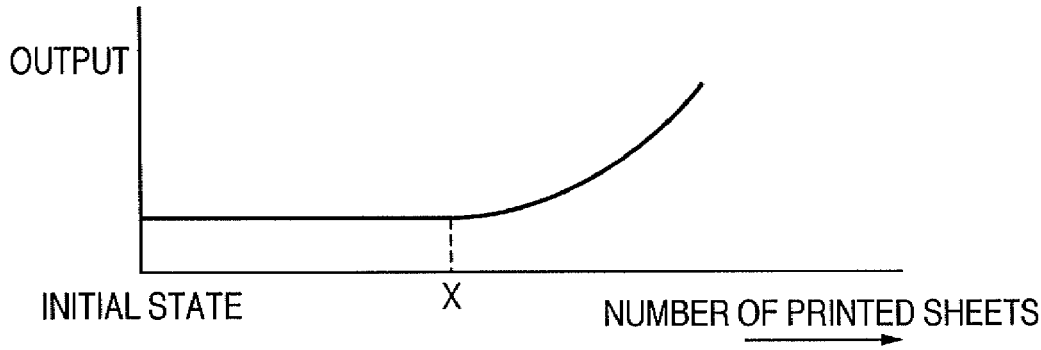
FIGS. 9A and 9B are graphs for explaining a change in the light reflectance according to a decrease in an ink.

FIG. 9A schematically shows a state in which the output from the photo interrupter 123 continuously changes. FIG. 9A shows the relationship between the output from the photo interrupter 123 (ordinate) and the number of printed sheets (abscissa) of a printing medium, which increases when printing is executed from the initial state until the ink in the ink tank 102 runs out. The output from the photo interrupter 123 is almost constant until the number of printed sheets reaches X. When the number of printed sheets exceeds X, the ink in the area irradiated with light from the photo interrupter 123 decreases, and the output from the photo interrupter 123 becomes large. Hence, after the number of printed sheets has exceeded X, the output value of the photo interrupter is measured every time a predetermined amount of ink is consumed. When the output change before and after the consumption is detected, the amount of remaining ink in the ink tank 102 can be detected based on the output change ratio and the relationship shown in FIG. 9A.

Figure 9B:
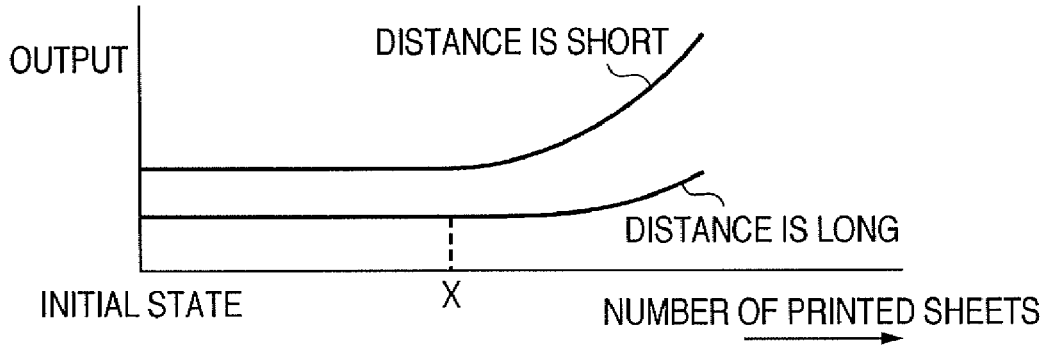

FIG. 9B is a graph showing the output characteristic difference depending on the distance between the photo interrupter 123 and the ink tank 102. As is apparent from FIG. 9B, the value of the number X of printed sheets corresponding to the output change point rarely changes depending on the set distance.

Figure 10:
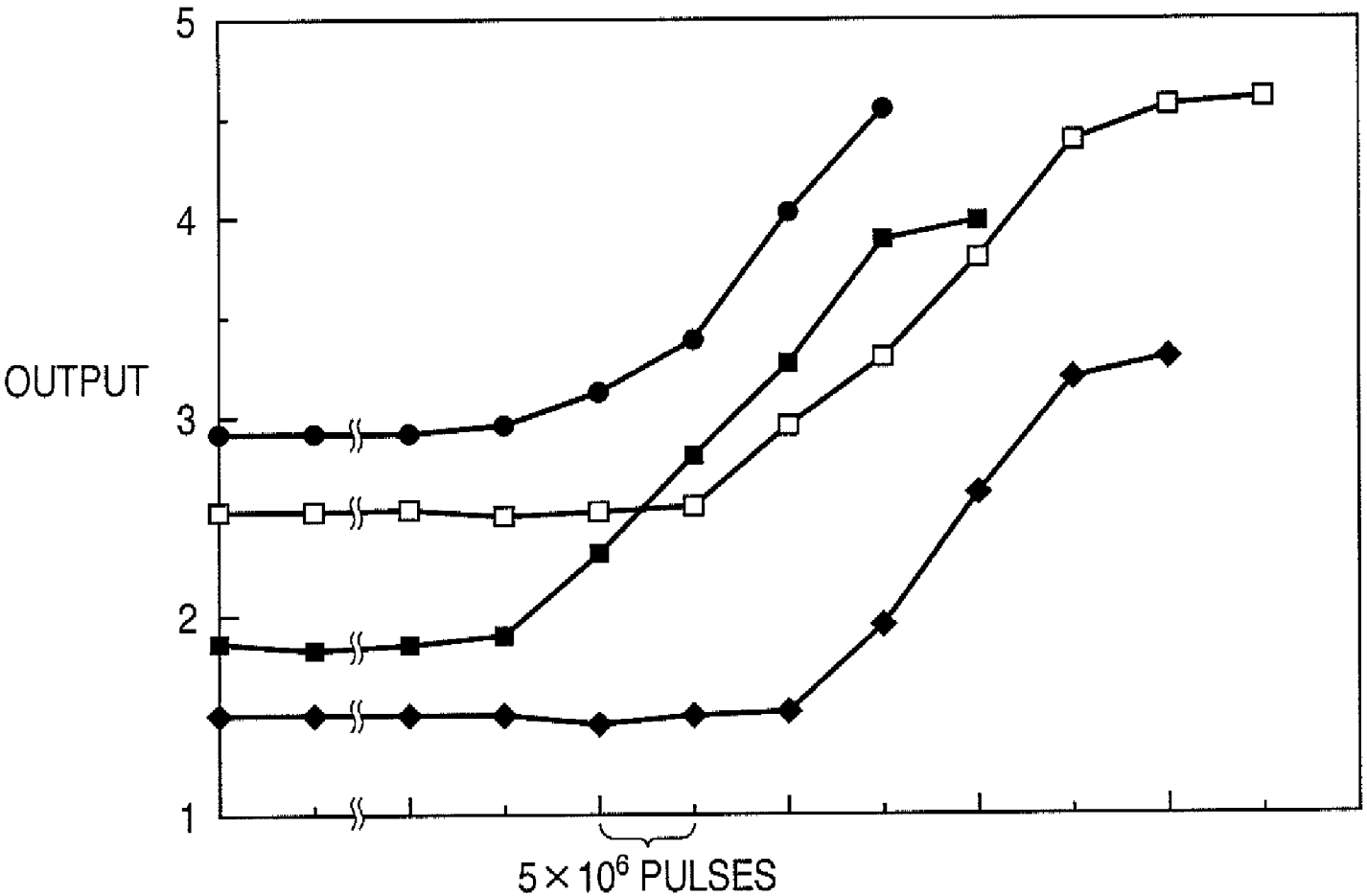
FIG. 10 is a graph for explaining a change in the light reflectance for each ink.

FIG. 10 shows the actual output characteristic for each of the four different ink tanks. FIG. 10 plots the measurement results of output values for each amount of consumed ink corresponding to $5\times10^6$ pulses when a predetermined image is printed using these ink tanks. Note that the output value represented by the ordinate is obtained by subtracting the output (bright voltage) from the photo interrupter in the LED ON state from the output (dark voltage) from the photo interrupter in the LED OFF state.

As is apparent from FIG. 10, since the output values change between the ink tanks, it is difficult to detect the amount of remaining ink by defining a single threshold value for the output values of the respective tanks. However, it is possible to detect the amount of remaining ink of each ink tank by measuring the amount of change (change ratio) of the output value for each ink tank.

As described above, the output from the photo interrupter 123 is almost constant until the number of printed sheets reaches X. This is because there is a sufficient amount of ink in the area irradiated with light from the photo interrupter 123 before the number of printed sheets reaches X. Using this fact, if an ink tank is exchanged with a new one after amount of remaining ink detection, the operation of notifying the user of a small amount of remaining ink may automatically be stopped for a predetermined period after detecting that the output change is small.

The present invention is applicable not only to a printing apparatus capable of independently attaching the printhead 312 and ink tank 102 but also to a printing apparatus using a head cartridge including the printhead 312 integrated with the ink tank 102.

Figure 12:
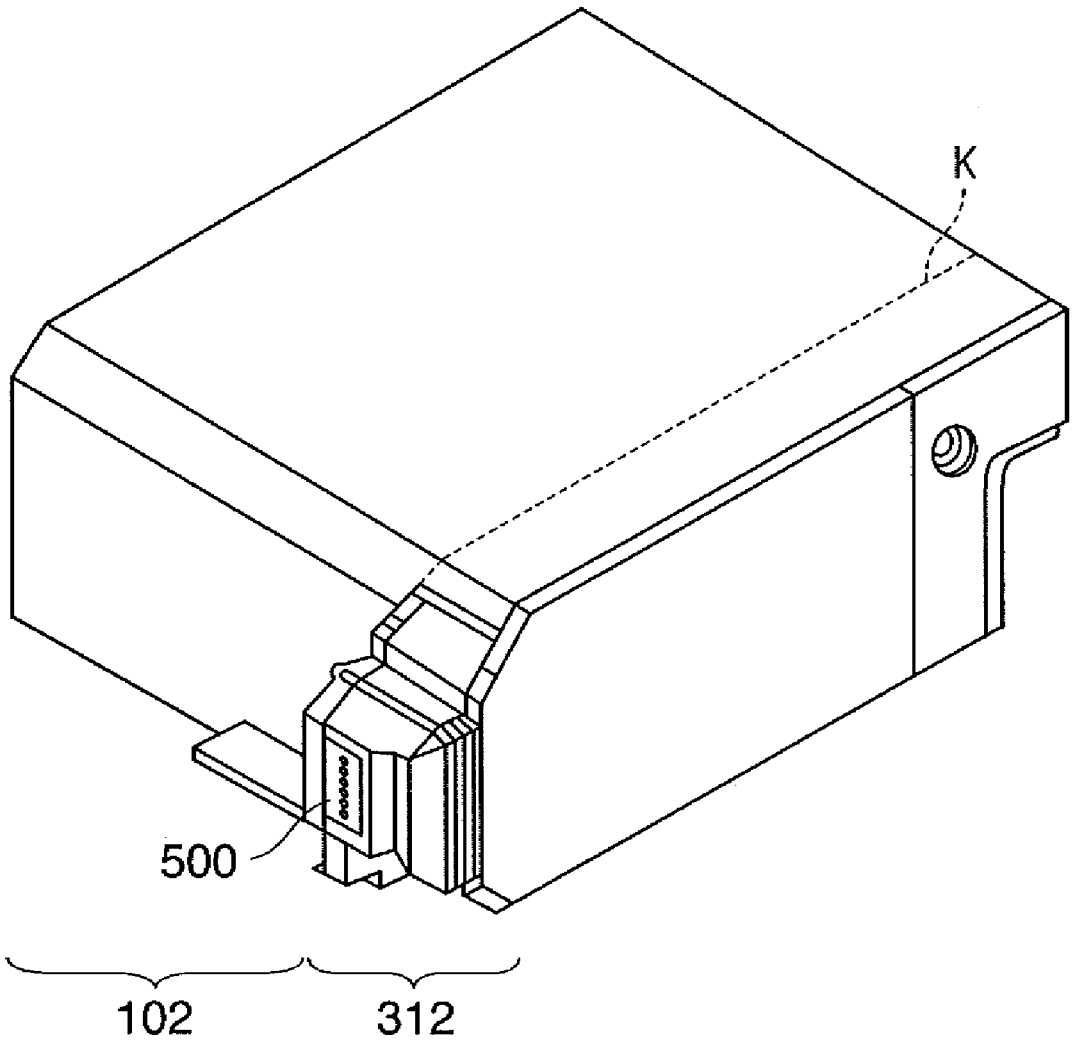
FIG. 12 is an external perspective view showing the arrangement of a head cartridge including a printhead integrated with an ink tank.

FIG. 12 is an external perspective view showing the arrangement of the head cartridge including the printhead 312 integrated with the ink tank 102. Referring to FIG. 12, a dotted line K indicates the boundary between the ink tank 102 and the printhead 312. Light output from the photo interrupter 123 irradiates the ink tank 102 to detect the amount of remaining ink, as in the above-described head cartridge separately including the ink tank 102 and printhead 312. The head cartridge has an electrode (not shown) which receives an electrical signal supplied from the carriage side when the head cartridge is mounted on the carriage. The printhead is driven to discharge the ink, as described above, in accordance with the electrical signal. Reference numeral 500 in FIG. 12 denotes an ink orifice array.

(First Embodiment)

Figure 11A:
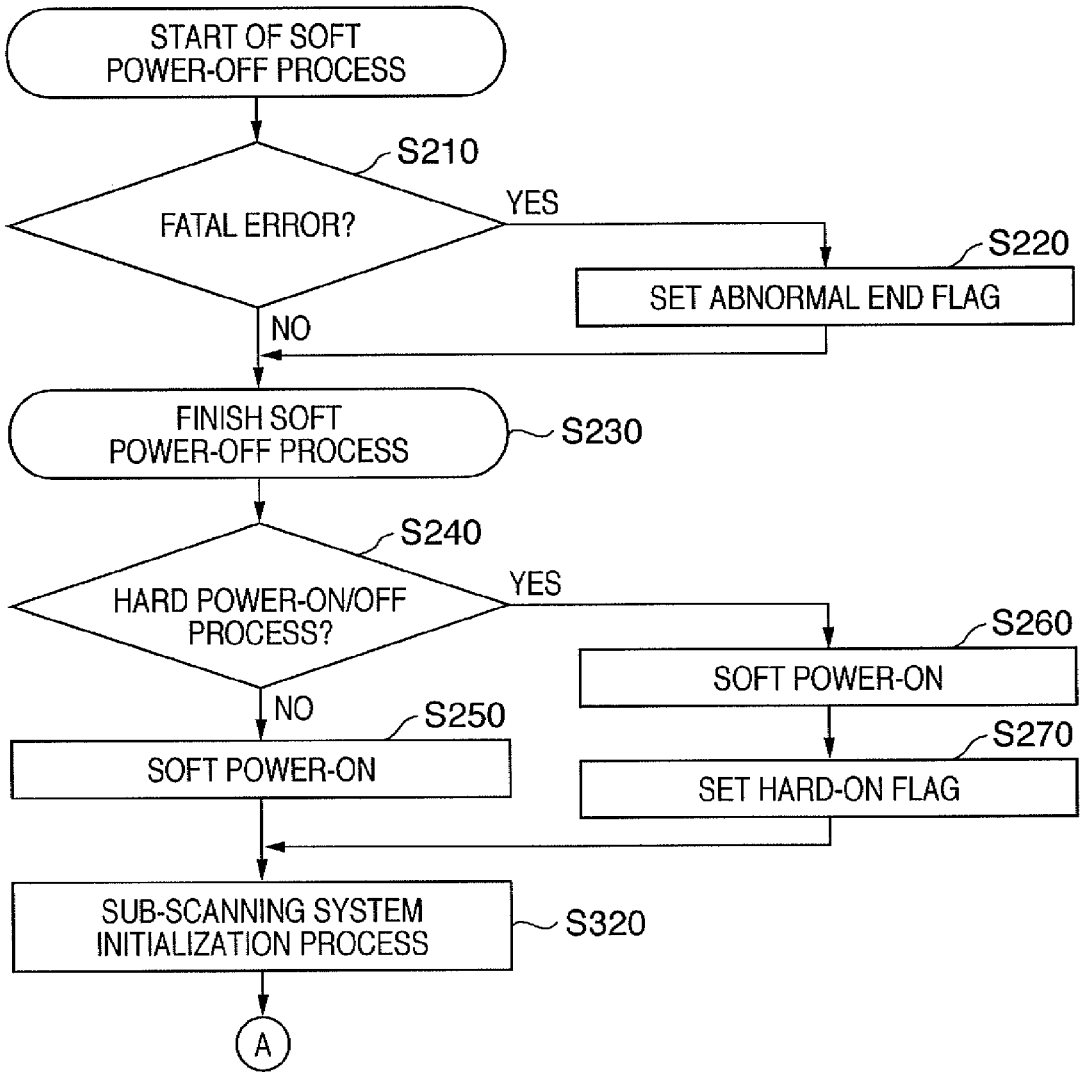
FIGS. 11A and 11B are flowcharts illustrating an initialization operation according to the first embodiment of the present invention.
Figure 11B:
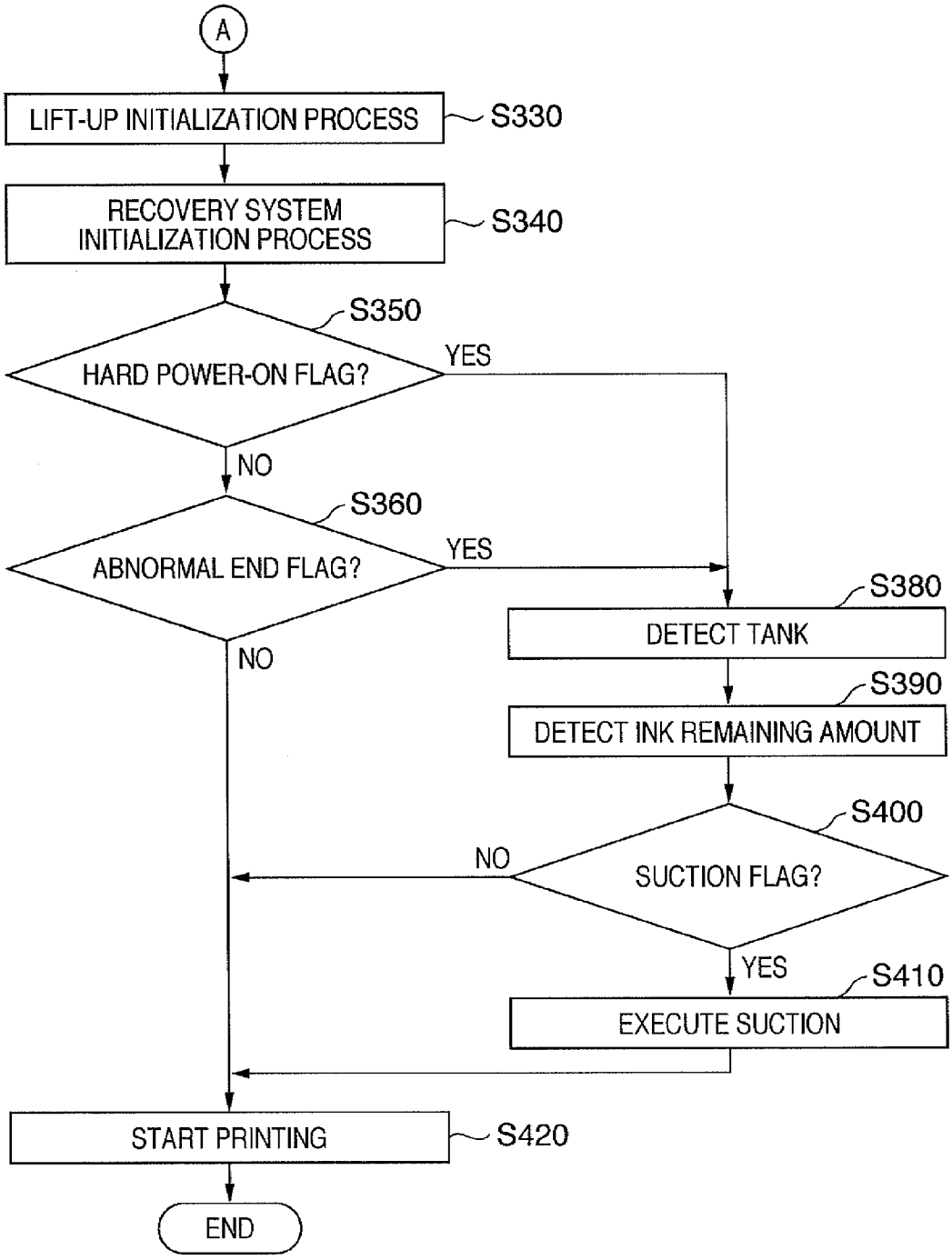

FIGS. 11A and 11B are flowcharts for explaining an example of an initialization operation that is executed until a printing operation starts after a printing apparatus is powered off and then powered on again. In this specification, a state in which a power supply supplies power to the printing apparatus will be referred to as a hard power-on status. A state in which the power supply supplies no power to the printing apparatus will be referred to as a hard power-off status. A state in which the printing apparatus can operate in the hard power-on status will be referred to as a soft power-on status. A state in which the printing apparatus cannot execute the printing operation in the hard power-on status because no power is supplied to, for example, circuits for executing printing will be referred to as a soft power-off status. Power-off indicates a process of executing only soft power-off while keeping the hard power-on status. Power-on indicates a process of executing soft power-on in the hard power-on status or a process of executing hard power-on and soft power-on in the hard power-off status. The soft power-off process starts to power off the printing apparatus. If a fatal error has occurred in step S210, it is determined to be an abnormal end. Based on the determination result, an abnormal end flag is set and stored in the nonvolatile rewritable storage device of the system controller 301 in step S220. The soft power-off process is ended (step S230). If no fatal error has occurred in step S210, the soft power-off process is directly ended (step S230).

In this embodiment, for example, the following abnormal operations are detected as fatal errors. When a soft power-off instruction is issued, the individual mechanisms of the printing apparatus operate to be set at predetermined positions. However, the operation may be incomplete because of hard power-off halfway during the operation. Soft power-off may occur without solving a paper jam error. During the operation executed in accordance with a soft power-off instruction, an ink tank attachment error may be recognized. In this embodiment, such an error is detected as a fatal error, and its information is stored in the nonvolatile storage device.

Figure 1:
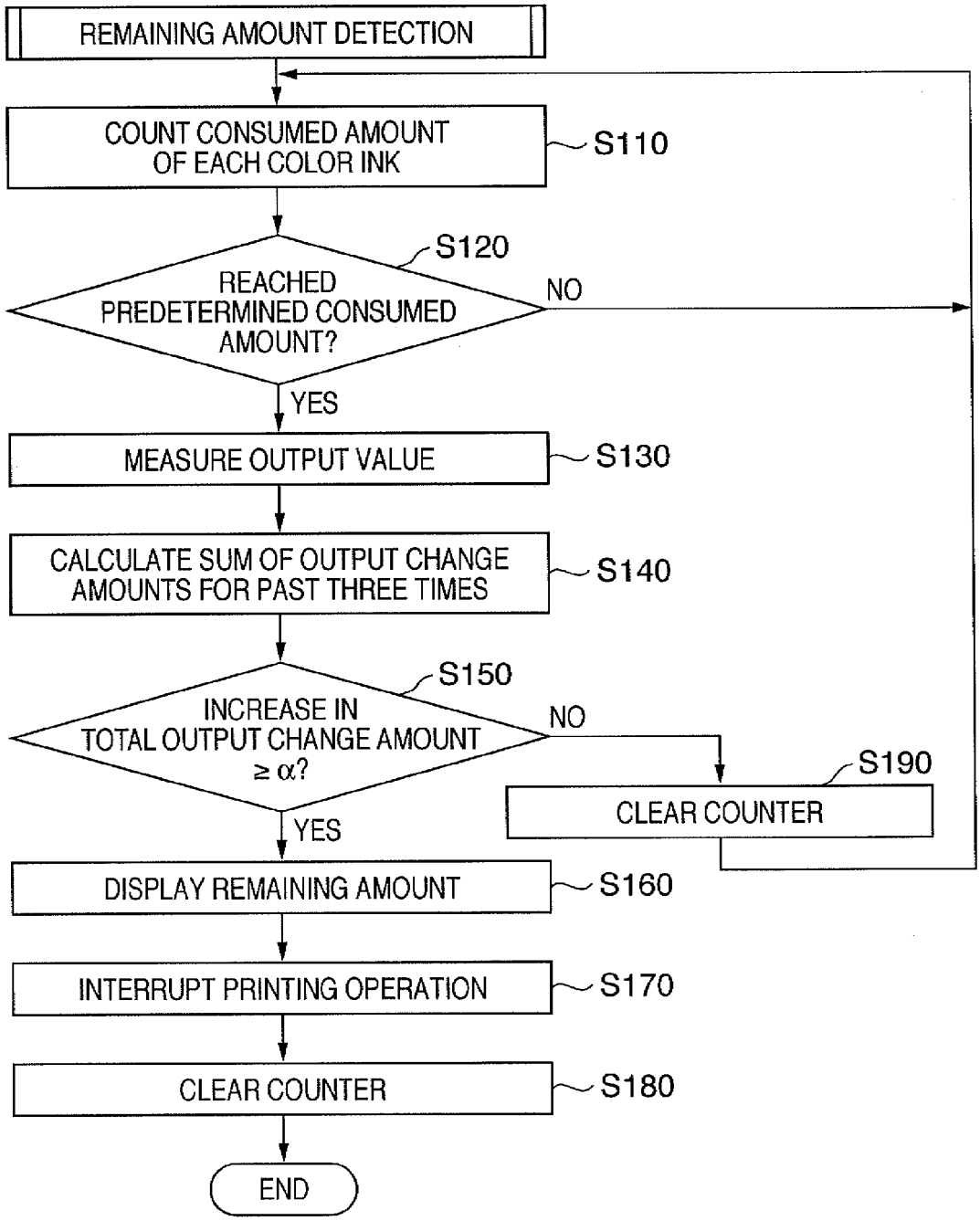
FIG. 1 is a flowchart illustrating a conventional remaining amount detection process.
Figure 2:
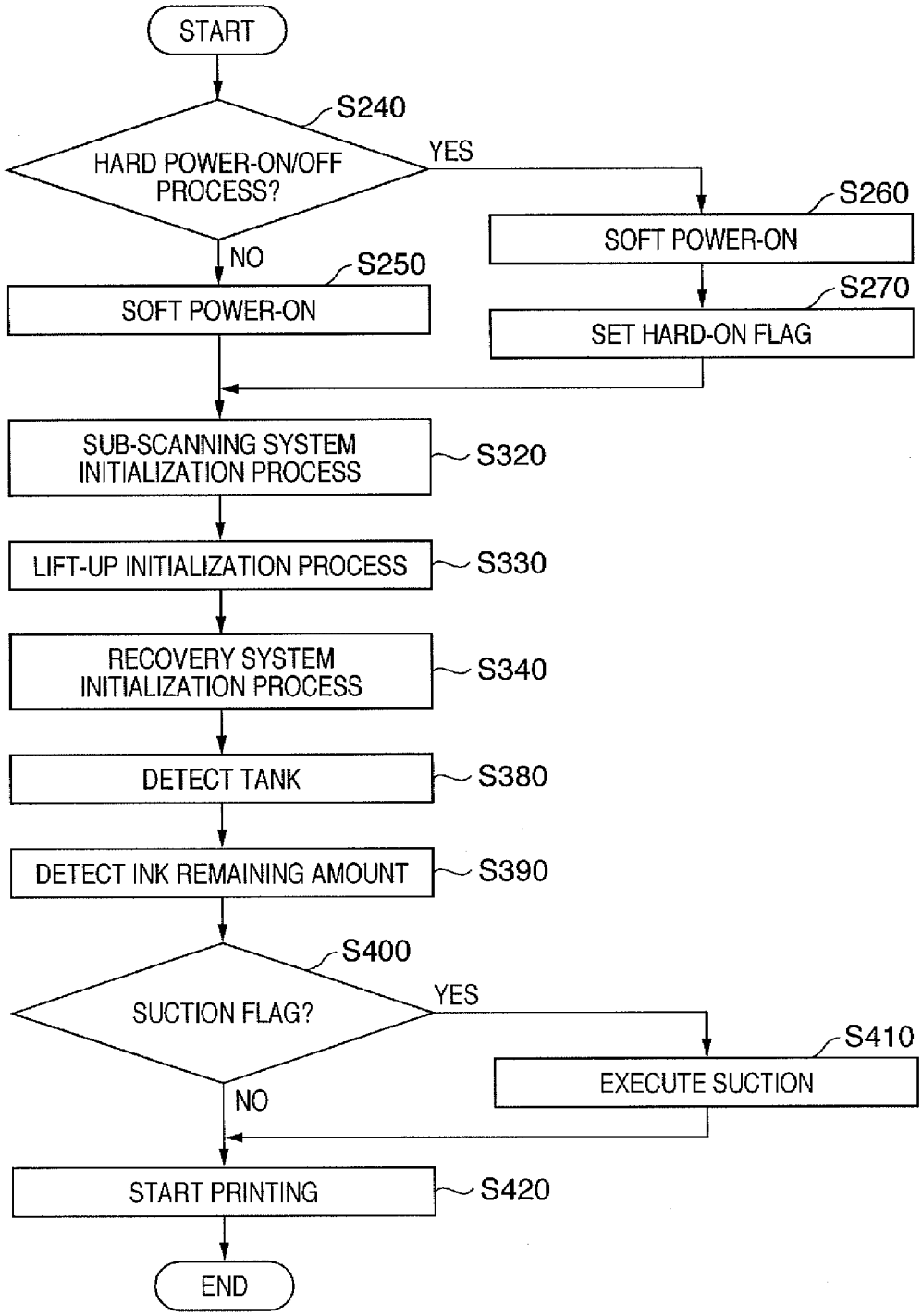

The processes in steps S240 to S340 are the same as in FIG. 2, and a description thereof will not be repeated. If it is determined in step S240 to execute the hard power-on process, and the hard power-on process is executed, the information (hard power-on flag) is stored in the nonvolatile rewritable storage device of the system controller 301 in step S270.

In step S350, it is confirmed whether a hard power-on flag exists. If it is confirmed that a hard power-on flag exists, the process advances to step S380. If it is confirmed that no hard power-on flag exists, the process advances to step S360. In step S360, it is confirmed whether an abnormal end flag exists. If it is confirmed that an abnormal end flag exists, the process advances to step S380. If it is confirmed that no abnormal end flag exists, the process advances to step S420. The processes in steps S380 to S420 are the same as in FIG. 2, and a description thereof will not be repeated.

As described above, the amount of remaining ink detection in step S390 is executed when at least one of the following conditions is satisfied. Otherwise, amount of remaining ink detection as the initialization operation is inhibited.

The first condition for amount of remaining ink detection is that the hard power is OFF at the start of printing, and the hard power-on process is necessary. The second condition for amount of remaining ink detection is that a fatal error has occurred before ending the preceding printing operation and turning off the soft power.

More specifically, the first condition is satisfied when, for example, the preceding printing operation is ended, the soft power is normally turned off, and the hard power is also turned off and then kept off until the start of printing. That is, in the hard power-off status, since no power is supplied to the printing apparatus, it is impossible to detect a change in the printing apparatus such as ink tank detachment. Hence, in this embodiment, when the first condition is satisfied, amount of remaining ink detection is executed in the initialization sequence.

As described above, in this embodiment, if the operation executed in accordance with a soft power-off instruction is normally ended, and no hard power-on process is executed, amount of remaining ink detection in the initialization sequence is omitted, thereby starting printing in a short time.

In this embodiment, amount of remaining ink detection is executed when at least one of the first and second conditions is satisfied. However, the present invention is not limited to this arrangement. Printing may be started in a shorter time by adopting only one of the conditions to determine whether to execute amount of remaining ink detection before the start of printing.

(Second Embodiment)

In the first embodiment, execution of amount of remaining ink detection is controlled in accordance with the condition that the hard power-on process is required at the start of printing, and the condition that whether a fatal error has occurred at the time of soft power-off. In the second embodiment, whether to execute amount of remaining ink detection is determined not only based on the two conditions of the first embodiment but also by detecting the state of the printing apparatus after power-on. More specifically, whether to execute amount of remaining ink detection is determined by detecting whether a cap is open and whether a log of ink tank or printhead detachment/attachment is present.

A description of the arrangement and control method already described in the first embodiment will not be repeated below. A characteristic arrangement of the second embodiment will mainly be explained.

Figure 13A:
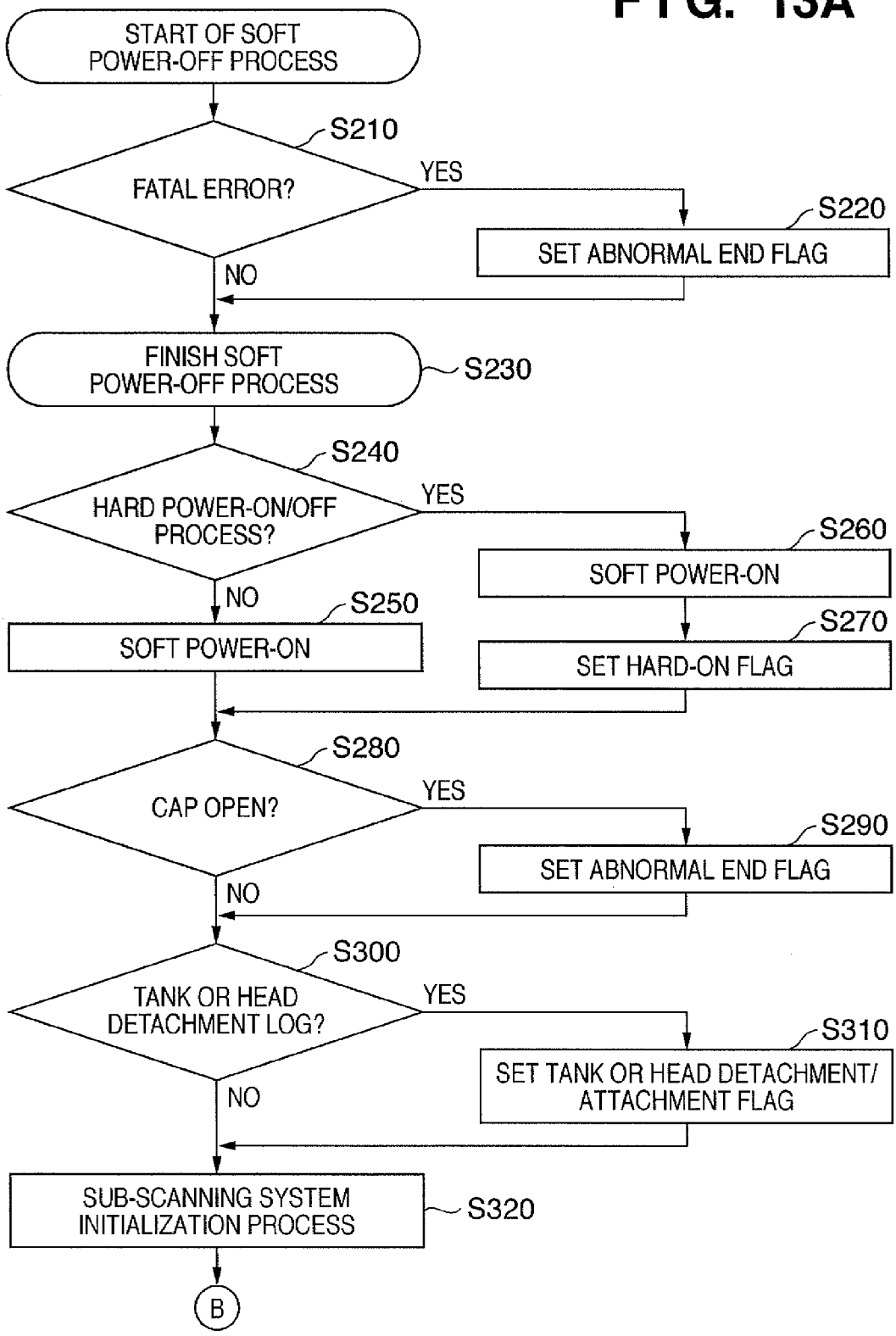
FIGS. 13A and 13B are flowcharts illustrating an initialization operation according to the second embodiment of the present invention.
Figure 13B:
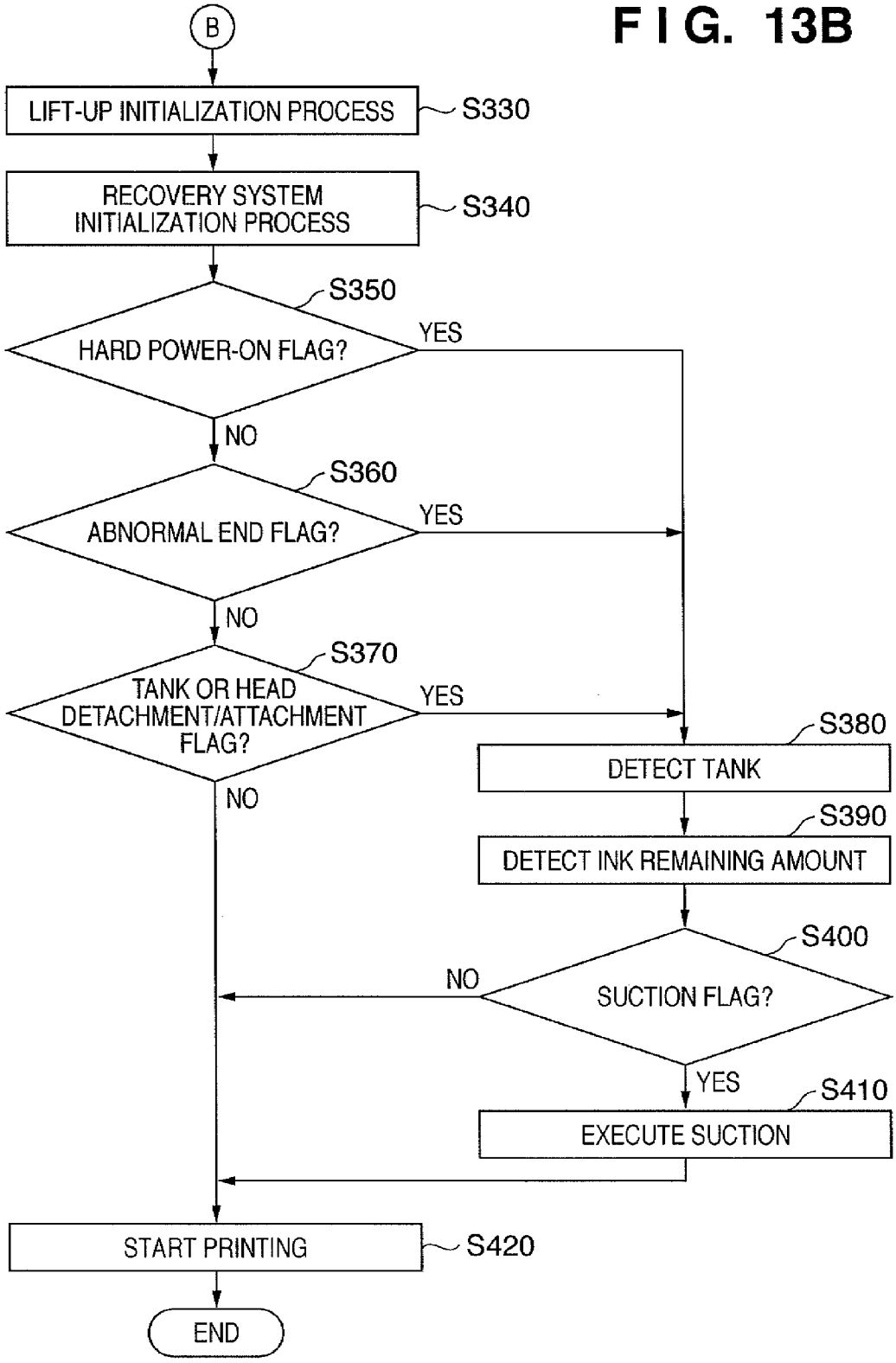

FIGS. 13A and 13B are flowcharts for explaining an initialization operation that is executed until printing starts after a printing apparatus is powered off and then powered on again.

The processes in steps S200 to S270 associated with the soft power-off process of powering off the printing apparatus and the hard power-on process of powering on the printing apparatus are the same as those already described, and a description thereof will not be repeated.

After step S270, the process advances to step S280 to determine whether the cap (CAP) is open at the time of soft power-on. If the cap is open, an abnormal end flag is set in step S290. The process advances to step S300. If the cap is not open, the process directly advances to step S300.

In step S300, it is confirmed whether a log of ink tank or printhead detachment/attachment is present. If a detachment/attachment log is present, an ink tank or printhead detachment/attachment flag is set and stored in the nonvolatile storage device of a system controller 301 (step S310). The process advances to step S320. If no log of ink tank or printhead detachment/attachment is present in step S300, the process directly advances to step S320.

The processes in steps S320 to S350 are the same as in the first embodiment, and a description thereof will not be repeated. In the second embodiment as well, when the hard power-on process is executed at the start of printing in step S350, amount of remaining ink detection is performed.

In step S360, it is confirmed whether an abnormal end flag exists. If it is confirmed that an abnormal end flag exists, the process advances to step S380. If it is confirmed that no abnormal end flag exists, the process advances to step S370. In the first embodiment, only when a fatal error has occurred at the time of soft power-off process, it is determined in step S360 that an abnormal end flag exists, and amount of remaining ink detection is executed in step S390. In the second embodiment, however, even when the cap is open at the time of soft power-on process in step S280, an abnormal end flag is set. Hence, in step S360, not only when a fatal error has occurred at the time of soft power-off process but also when the cap is open at the time of soft power-on process, the process advances to step S390 to detect the amount of remaining ink.

In step S370, it is confirmed whether an ink tank or printhead detachment/attachment flag exists. If it is confirmed that an ink tank or printhead detachment/attachment flag exists, the process advances to step S380. If it is confirmed that no ink tank or printhead detachment/attachment flag exists, the process advances to step S420 to start printing. The processes in steps S380 to S420 are the same as those already described, and a description thereof will not be repeated.

As described above, in this embodiment, the state of the printing apparatus after power-on is confirmed. When the cap is open, and when a log of ink tank or printhead detachment/attachment is present, amount of remaining ink detection is executed.

According to this embodiment, when the soft power-off process and the like are normally executed, and the cap is removed later during, for example, transport of the printing apparatus, amount of remaining ink detection in the initialization sequence is executed. If the cap is open at the start of printing, normal printing may be impossible due to evaporation of the ink in the printhead. In this embodiment, however, amount of remaining ink detection is performed when the cap is open in power-on. It is therefore possible to maintain satisfactory image printing.

An ink tank may be exchanged with an ink tank containing a small amount of ink between the end of preceding printing and the start of printing. However, this embodiment prevents any trouble such as a blurred image printed using an ink tank with a small amount of remaining ink because amount of remaining ink detection is executed in accordance with the ink tank detachment/attachment log. In, for example, a printing apparatus capable of separating an ink tank from an inkjet head, the joint portion between the ink tank and the printhead may be exposed to air at the time of printhead detachment, and the ink may evaporate from the joint portion. This may cause an ink supply failure at the joint portion between the mounted printhead and ink tank. When the printhead is detached, suction recovery is necessary for preventing the ink supply failure. In this embodiment, amount of remaining ink detection is done.

In this embodiment, if the cap is open, and if a log of ink tank or printhead detachment/attachment is present after power-on, amount of remaining ink detection is executed. It is therefore possible to print a high-quality image although the process may require a longer time until the start of printing than in the first embodiment. The present invention is not limited to the arrangement which determines whether the cap is open and whether an ink tank or printhead detachment/attachment log is present and inhibits amount of remaining ink detection based on both determination results. For example, printing may be started in a shorter time by adopting only one of the conditions to determine whether to execute amount of remaining ink detection at the start of printing.

(Other Embodiments)

The above embodiments particularly use, of inkjet printing methods, a method of changing the ink state using thermal energy generated by a unit for generating the thermal energy for ink discharge, thereby implementing high-density high-resolution printing.

The printing apparatus need not always operate only in a print mode using only a main color such as black. By combining or integrating a plurality of printheads, the apparatus can have at least one of a multicolor mode using different colors and a full-color mode based on color mixture.

Furthermore, the printing apparatus according to the present invention may take the form of an integrated or separate image output terminal for an information processing device such as a computer. The printing apparatus may also take the form of a copying apparatus combined with a reader, or a facsimile apparatus having a transmission/reception function.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-114503, filed Apr. 24, 2007, which is hereby incorporated by reference herein in its entirety.

What is claimed is:

1. A printing apparatus for printing using a printhead which discharges ink contained in an ink tank, comprising:

detection means for detecting an ink remaining amount in the ink tank;

storage means for storing information indicating whether an error has occurred at a time of power-off; and control means for controlling an operation of said detection means in an initialization operation after power-on, wherein said control means inhibits the operation of said detection means (i) when the information stored in said storage means indicates that an error has not occurred at the time of power-off and (ii) when the printhead has not been detached or attached during a period between power-off and power-on.

2. The apparatus according to claim 1, wherein said detection means optically detects the ink remaining amount in the ink tank.

3. The apparatus according to claim 1, further comprising a cap which covers orifices of the printhead, wherein said control means controls to inhibit the operation of said detection means when said cap covers the printhead at the time of power-on.

4. The apparatus according to claim 1, wherein the ink tank is detachable from the printing apparatus, and said control means controls to inhibit the operation of said detection means when the ink tank has not been detached or attached between power-off and power-on.

5. The apparatus according to claim 1, wherein said storage means is a nonvolatile memory.

6. The apparatus according to claim 1, wherein said control means controls to inhibit the operation of said detection means when a hard power-on process is not executed at the time of power-on.

7. A printing apparatus according to claim 1, wherein said control means controls detecting the ink remaining amount in the ink tank, via said detection means, during the initialization operation after power-on.

8. An ink remaining amount detection method capable of detecting an ink remaining amount in an ink tank in a printing apparatus for printing using a printhead which discharges ink contained in the ink tank, the method comprising the steps of:

storing information indicating whether an error has occurred at a time of power-off; and controlling an operation of detecting the ink remaining amount in an initialization operation after power-on, wherein the operation of detecting the ink remaining amount is inhibited (i) when the information stored in the storing step indicates that an error has not occurred at the time of power-off, and (ii) when the printhead has not been detached or attached during a period between power-off and power-on.

9. A printing apparatus for printing using a printhead which discharges ink contained in an ink tank, comprising:

a detection unit configured to detect an ink remaining amount in the ink tank;

a storage unit configured to store information indicating whether an error has occurred at a time of power-off; and a controller to control an operation of said detection unit in an initialization operation after power-on, wherein said controller inhibits the operation of said detection unit during an initialization operation after power-on (i) when the information stored in said storage unit indicates that an error has not occurred at the time of power-off and (ii) when the printhead has not been detached or attached during a period between power-off and power-on.

10. The apparatus according to claim 9, wherein said detection unit optically detects the ink remaining amount in the ink tank.

11. The apparatus according to claim 9, further comprising:

a cap which covers orifices of the printhead, wherein said controller inhibits the operation of said detection unit when said cap covers the printhead at the time of power-on.

12. The apparatus according to claim 9, wherein the ink tank is detachable from the printing apparatus, and said controller inhibits the operation of said detection unit when the ink tank has not been detached or attached between power-off and power-on.

13. The apparatus according to claim 9, wherein said storage unit is a nonvolatile memory.

14. The apparatus according to claim 9, wherein said controller inhibits the operation of said detection unit when a hard power-on process is not executed at the time of power-on.

* * * * *